US005415734A

United States Patent [19]

Backlund et al.

[11] Patent Number: 5,415,734

[45] Date of Patent: May 16, 1995

[54] PROCESS FOR BLEACHING PULP WITHOUT USING CHLORINE CONTAINING CHEMICALS

[75] Inventors: Ake Backlund; Stig Andtbacka, both of Karlstad; Bjorn Dillner, Saffle, all of Sweden

[73] Assignee: Kvaerner Pulping Technologies AB, Karlstad, Sweden

[21] Appl. No.: 59,404

[22] Filed: May 11, 1993

[30] Foreign Application Priority Data

May 11, 1992 [SE] Sweden ..... 01477/92

[51] Int. Cl.[6] ..... D21C 9/147; D21C 9/153; D21C 9/16

[52] U.S. Cl. ..... 162/40; 162/60; 162/65; 162/78

[58] Field of Search ..... 162/65, 78, 76, 40, 162/57, 30.1, 30.11, 29, 15, 60

[56] References Cited

U.S. PATENT DOCUMENTS

| | | | |
|---|---|---|---|
| 3,348,390 | 10/1967 | Richter . | |
| 3,563,891 | 2/1971 | Richter . | |
| 3,963,561 | 6/1976 | Richter . | |
| 4,372,812 | 2/1983 | Phillips et al. | 162/40 |
| 4,436,586 | 3/1984 | Elmore . | |
| 4,547,264 | 10/1985 | Sherman et al. . | |
| 4,668,340 | 5/1987 | Sherman . | |
| 4,840,047 | 6/1989 | Richter et al. . | |
| 4,854,819 | 8/1989 | Gullichsen . | |
| 4,971,694 | 11/1990 | Richter . | |
| 4,976,586 | 12/1990 | Richter et al. . | |
| 5,053,108 | 10/1991 | Richter . | |
| 5,069,752 | 12/1991 | Richter . | |
| 5,080,755 | 1/1992 | Backlund . | |
| 5,131,980 | 7/1992 | Chamblee et al. . | |

FOREIGN PATENT DOCUMENTS 402335 12/1990 European Pat. Off. .

OTHER PUBLICATIONS

Bleaching a Softwood Kraft Pulp Without Chlorine Compounds, N. Liebergott, et al. pp. 323–332 Liebergott et al.

Emerging Technologies Today and in the Future, Copyright 1992, pp. 1–6, Basta et al.

1981 Oxidative Bleaching, Denver Hilton, Denver, Colo., Oct. 22, Copyright 1981, pp. 75–78, Schleinkofer.

Optimized Hydrogen Peroxide Bleaching in Closed White-Water Systems, Rolf Anderson, et al pp. 111–115.

Tritshler et al, "Commercial Manufacture and Ind. Use of Ozone As An Oxidant".

*Primary Examiner*—Steve Alvo

*Attorney, Agent, or Firm*—Cushman Darby & Cushman

[57] ABSTRACT

A process is disclosed for bleaching pulp without chlorine containing chemicals and for greatly reducing total washing filtrate discharge, comprising the steps of: 1) sending pulp that has been subjected to continuous digestion, oxygen-delignification and then washing, through a washing press; 2) treating, with agitation, the delignified washed pulp with sulfuric acid and a chelating agent; 3) washing the pulp in a washing apparatus; 4) bleaching with hydrogen peroxide in a reaction vessel; 5) washing the hydrogen peroxide bleached pulp; 6) adding sulfuric acid and ozone with mixing of the pulp; 7) reacting the pulp with ozone in a reaction vessel; and 8) washing the ozone reacted pulp, wherein the majority of liquid filtrate from the bleaching process that is waste not to be recycled is drawn off from the washing apparatus of step 3, the washings in step 3 and 5 have at least 85% efficiency, filtrate from washing step 5 is recirculated to the washing apparatus of step 3, and filtrate from the washing apparatus of step 8 is recirculated and used in the washing apparatus for the washing of pulp after oxygen-delignification.

26 Claims, 1 Drawing Sheet

PROCESS FOR BLEACHING PULP WITHOUT USING CHLORINE CONTAINING CHEMICALS

BACKGROUND OF THE INVENTION

1. Field of the Invention

This invention relates to a process for bleaching pulp without using organic chlorine compounds but still achieving levels of brightness required by the market e.g. 85–90 ISO. Before bleaching, pulp is continuously digested in a modified continuous cooking (MCC) digester (e.g. that described in U.S. Pat. No. 5,080,755 and U.S. patent application, Ser. No. 08/051,396 each incorporated by reference, herein). Subsequent to MCC digestion, the pulp undergoes oxygen-delignification in a modified continuous (MC) oxygen delignification process (e.g. that described in U.S. Pat. No. 3,963,561, incorporated by reference herein), until a low lignin level is achieved, e.g. low Kappa numbers of 10 or less.

The novel process not only achieves good brightness and low lignin levels without using organic chlorides to bleach, but allows for very low levels of bleaching liquid discharge such that total filtrate, from washing of pulp during the bleaching process, that leaves the bleaching plant may be limited to 3 to 10 tons of liquid per ton of 90% pulp. Essentially, the novel process comprises treating the delignified pulp with sulfuric acid and a chelating agent such as EDTA, washing pulp in a single or double-diffuser washing tower (e.g., that described in U.S. Pat. No. 3,348,390 (single diffuser) and U.S. Pat. Nos. 3,563,891, 4,840,047 and 4,971,694 (double-diffusers), each of the foregoing patents' disclosures are incorporated by reference, herein), bleaching the pulp with hydrogen peroxide in a single or double-diffuser washing tower, adding sulfuric acid and ozone with mixing, reacting ozone with the pulp in a reaction vessel, and washing the ozone reacted pulp in a washing tower, wherein liquid filtrates from the aforesaid washing steps are recirculated to earlier washing steps and where single or double-diffuser washing steps have a high efficiency of at least 85%.

2. Description of the Prior Art

The environmental protection authorities are making ever more stringent demands on the pulp industry to decrease the use of chlorine gas in bleaching. Permitted discharges of organic halogen compounds (AOX) in the waste water from bleaching plants have been gradually lowered and are now at such a low level that the pulp factories have in many cases stopped using chlorine gas. Instead, only chlorine dioxide is used as a bleaching agent. In achieving the same bleaching effect, chlorine dioxide forms smaller quantities of AOX than does chlorine gas. However, the polluting effects of chlorine dioxide have likewise been questioned. On the one hand, the environmental protection authorities in certain countries require that the discharges of organic chlorine compounds be reduced to such a low level that the requirements can hardly be fulfilled even if only chlorine dioxide is used for bleaching. On the other hand, environmental movements in several countries, in particular in Germany, have persuaded consumers to demand paper products which have been bleached entirely without using either chlorine gas or chlorine dioxide.

The pulp industry is therefore searching for methods which permit pulp to be bleached without using these chemicals. One such method has been developed by the Swedish company Eka, which supplies bleaching chemicals to the pulp industry. The bleaching method, which is called LIGNOX (e.g. as described in SE-A-8902058), involves the unbleached pulp being first delignified with oxygen and then, after washing, being treated with EDTA, or other suitable chelating agent, in order to remove heavy metals bound within the pulp. The EDTA treatment stage (denoted as Q state, hereafter) is followed by an intensive bleaching stage with peroxide (denoted as P stage, hereafter), i.e. hydrogen peroxide. The charge of hydrogen peroxide ($H_2O_2$) employed is relatively high, 15–35 kg per ton of pulp, depending on the brightness required and on the bleachability of the pulp. The time is quite long, 4 hours or longer, and the temperature high, 80°–90° C.

However, the LGNOX method only provides a limited increase in brightness. Maximum brightness depends on the bleachability of the pulp and the charge of peroxide. Brightness in the region of 80–82 ISO has been achieved using the LIGNOX method. To achieve higher levels of brightness, further bleaching stages are required over and above the peroxide stage.

In this connection, ozone is an interesting bleaching chemical. At least one experiment has shown that if an ozone bleaching stage (denoted Z stage, hereafter) is introduced after a peroxide stage, a significant increase in brightness is achieved while at the same time lignin content of the pulp is decreased. The latter point is important, since a pulp bleached with only peroxide or oxygen/peroxide still contains a relatively high content of lignin, which affects the brightness reversion tendency of the pulp. When high lignin content pulp is warmed or irradiated with sunlight, the pulp yellows. If ozone is used, further lignin is removed, resulting in the brightness of the pulp becoming more stable.

A.G. Lenzing (See EP-A-441 113) has demonstrated how an ozone stage after a peroxide stage increases the brightness of sulphite pulp. If a peroxide stage is allowed to follow the ozone stage, a further increase in brightness is obtained.

Eka has shown that this is also the case for sulphate pulp. Oxygen-bleached sulphate pulp was treated with EDTA to remove heavy metals and subsequently the pulp was bleached with peroxide and ozone according to the stage sequence QPZ. With this sequence, brightness in the region of 82–87 ISO was achieved, depending on the type of pulp. By extending the bleaching sequence with a further peroxide stage and bleaching according to the stage sequence QPZP, brightness in the region of 87–89 ISO was obtained, depending on the type of pulp, See "Non Chlorine Bleaching," J. Basta, L. Andersson, W. Hermanson; Proceedings Mar. 2–5, 1992—Westin Resort—Hilton Head—South Carolina; Copyright by Miller Freeman, Inc.

Thus, it is possible, using process stage sequences QPZ and QPZP, to achieve the levels of brightness which the market requires for paper pulp, i.e., 87 ISO and higher, without using chlorine-containing bleaching agents. This provides interesting perspectives regarding both the effect of cellulose factories on the environment and the possibility of satisfying the demands of consumers for access to chlorine-free bleached pulps.

A prerequisite for achieving high levels of brightness while using moderate quantities of bleaching agents is that, prior to bleaching, the pulp should have been delignified to low kappa numbers, at least lower than kappa number 16.

Normally, a deterioration in quality, in particular loss of fiber strength, is obtained if the delignification in the digester house and oxygen-delignification are taken too far. However, using the modified digestion methods which have been developed in recent years, it has been found possible to achieve very low kappa numbers without loss of strength.

For example, it is possible, using a modification of Kamyr's continuous digestion processor or modified continuous cooking (MCC) as described in U.S. Pat. No. 5,080,755 and U.S. patent application Ser. No. 08/051,396, combined with modified continuous oxygen-delignification, e.g. that described in U.S. Pat. No. 3,963,561, to achieve and go below kappa number 10 with softwood, and kappa number 8 with hardwood, while retaining their strength properties. The modification of the MCC process involves the "Hi-heat" washing zone in the lower part of the continuous digester also being utilized for counter-current digestion (See for example U.S. patent application Ser. No. 07/583,043, incorporated by reference herein). This is achieved by heating to the full digestion temperature in the "Hi-heat" circulation and adding alkaline digestion liquid to this circulation. The total digestion time in countercurrent is thereby extended to 3–4 hours as compared with about 1 hour in conventional MCC. In this way a very low concentration or lignin is achieved by the end of the digestion, which provides improved selectivity in the delignification, i.e. the lignin of the wood is efficiently eliminated without the cellulose being significantly affected. The digestion and oxygen-delignification can thus be carried out to very low kappa numbers without impairing the properties of the pulp.

SUMMARY OF THE INVENTION

The present invention provides a novel process for bleaching pulp without chlorine containing chemicals and for greatly reducing total washing filtrate discharge from the bleaching plant. The process is carried out in a bleaching plant using washing presses and/or single-diffusers (one-stage diffusers) and/or double-diffusers (two-stage diffusers) washers. The novel process comprises the steps of:

1. sending pulp, that has been subjected to continuous digestion and then oxygen-delignification and then washing in a washing apparatus, through a washing press;
2. treating, with agitation, the delignified washed pulp with sulfuric acid and a chelating agent;
3. washing the pulp in a washing apparatus;
4. bleaching with hydrogen peroxide in a reaction vessel;
5. washing the hydrogen peroxide bleached pulp in a washing apparatus;
6. adding sulfuric acid and ozone with mixing of the pulp;
7. reacting the pulp with ozone in a reaction vessel;
8. washing the ozone reacted pulp in a washing apparatus;

wherein the majority of liquid filtrate from the bleaching process that is waste not to be recycled is drawn off from the washing apparatus of step 3, the washings in step 3 and 5 have at least 85% efficiency, filtrate from washing step 5 is recirculated and used as washing liquid for the washing apparatus of step 3, and filtrate from the washing apparatus of step 8 is recirculated and used in the washing apparatus for the washing of pulp after oxygen-delignification.

Alternately, the novel process may use an additional bleaching step 9 of bleaching with hydrogen peroxide using a peroxide charge of e.g. 1–3 kg. per ton of pulp and washing the pulp after it receives a second hydrogen peroxide bleaching, in a washing apparatus, e.g. a washing press, a single-diffuser washer, or double-diffuser washer, wherein the majority of liquid filtrate from the bleaching process that is waste not to be recycled is drawn off from the washing apparatus of step 3, the washings in step 3 and 5 have at least 85% efficiency, the filtrate from washing step 5 is recirculated and used as washing liquid for the washing apparatus of step 3, the filtrate from the washing apparatus of step 8 is recirculated and used in the washing apparatus for the washing of pulp after oxygen-delignification, and the filtrate from the step 9 washing is recirculated and used as washing liquid in the ozone washing of step 8.

The washing apparatus used in steps 3, 5, 8, and 9, mentioned above may be selected from the group consisting of a washing press, a single-diffuser washer, or a double-diffuser washer. Preferably a single-diffuser is used most preferably a double-diffuser is used.

A further alternative bleaching step 9 is bleaching the pulp with hydrogen sulphite and washing in a washing apparatus, e.g. a washing press, a single-diffuser washer, or a double-diffuser washer: preferably a single diffuser, most preferably a double-diffuser.

DESCRIPTION OF THE PREFERRED EMBODIMENT

Figure 1:
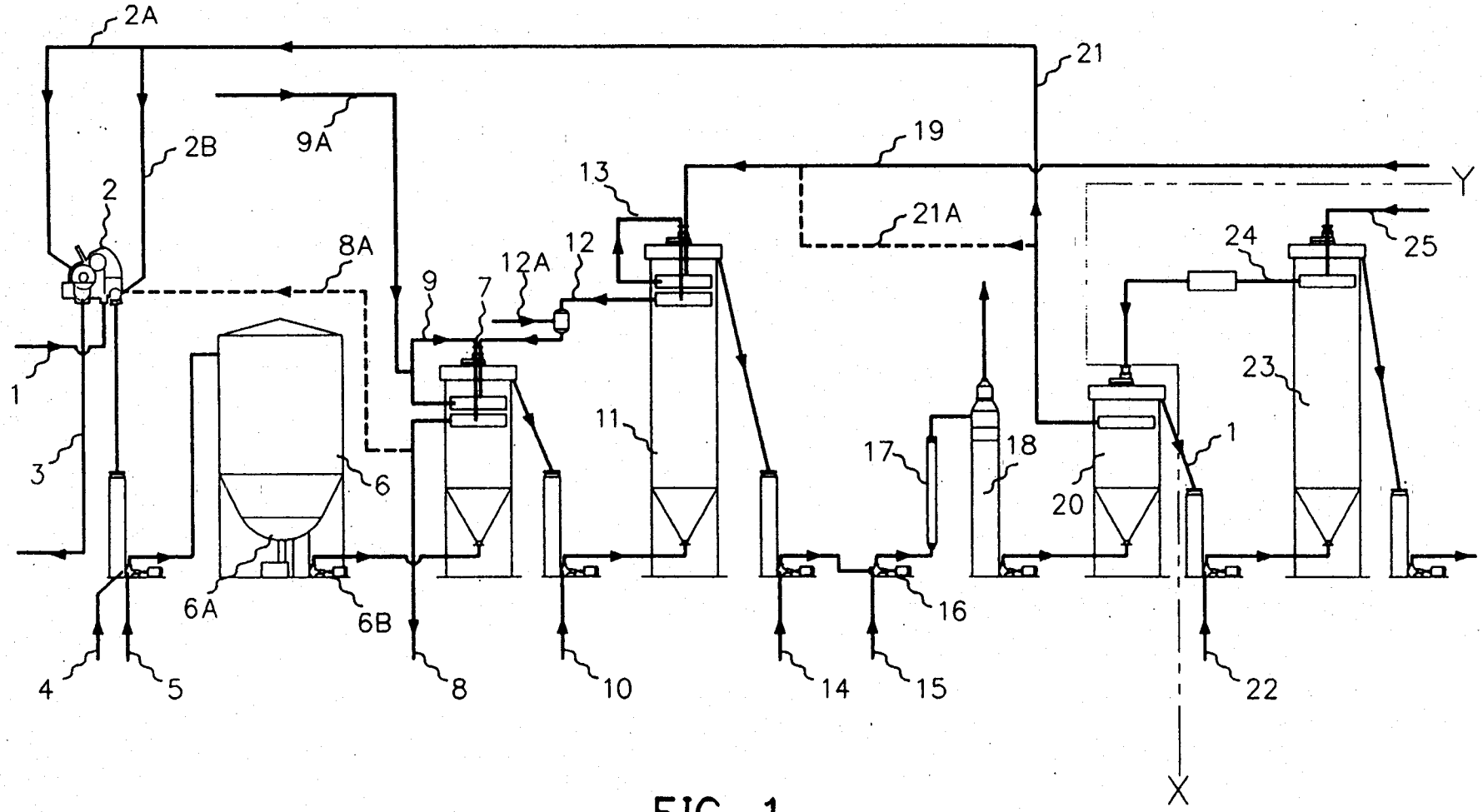
FIG. 1 is a schematic of a preferred pulp line for the process of the present invention.

In FIG. 1, a plant is shown, which is constructed for the process steps of the present invention. The bleaching plant consists of a transport conduit 1 for pulp which is indicated throughout FIG. 1 as a conduit in solid line, and which at the beginning of the bleaching plant leads to a washing process 2. Subsequently there is a chute and medium consistency (MC) pump (as described in U.S. Pat. Nos. 4,854,819 and 4,976,586 each incorporated by reference, herein) with inlet conduits 4 and 5 for the incorporation of EDTA (Q-stage) and sulfuric acid. Also included in this Q-stage are a storage tower 6 with agitator 6A and a chute with an MC pump 6B. Next there is a washing tower 7 comprising a double-diffuser, which can be a KAMYR washing apparatus as described in U.S. Pat. Nos. 3,563,891, 4,840,047, 4,971,694, each incorporated by reference, herein, or as described in Ullman's, Encyclopedia of Industrial Chemistry, v. A18 p. 573 VCH Publishers 1991 Library Congress No. 84-25-829. From this washing tower 7 the filtrate being voided from the bleaching point is drawn off via conduit 8. After the washing tower 7 there is a chute with an MC pump in which vigorous admixture of peroxide ($H_2O_2$), for a P-stage, takes place via conduit 10. Usually NaOH is added here, as well, in order to adjust the pH to the desired level. Next comes the reaction vessel 11 for the P-stage, which vessel is fitted at the top with a double-diffuser washer. After the P-stage there is a chute with a medium consistency (MC) pump with a supply conduit 14 for vigorous admixture of sulfuric acid. Then there is a mixer unit 16 for incorporating ozone gas (03), for the Z-stage, via conduit 15. Next there is a reaction vessel 17 for the pulp with the ozone, which vessel is connected by its upper attachment to a chute with a cyclone arrangement 18 in the upper part of which the ozone is drawn off in order to be rendered harmless in an ozone destroyer. The pulp, on the other hand, continues downwards and is pumped onwards to a second washing tower 20. Backwater, at a temperature of about 50° C., is appropriately employed as the washing liquid in the last washing tower 20.

Fresh water is taken into the system, e.g., at a temperature of about 45° C., via a conduit 19 which leads to the P-stage bleaching tower 11 and there feeds washing liquid to the double-diffuser, preferably to the double-diffuser's second stage. An additional contribution can, if necessary, also be obtained from the last washing tower 20 via conduit 21A. The filtrate from the second stage of the P-stage bleaching tower 11 double-diffuser is recirculated, as washing liquid, via conduit 13 to the first stage in this double diffuser. The filtrate from this double diffuser, in the P-stage bleaching tower 11, is led away via a conduit 12 which is attached to a heat exchanger, which exchanger is fed with steam 12A so that the filtrate is pre-heated before it is conveyed to the double-diffuser (preferably the second stage) in the first washing tower 7. Here too, recirculation occurs from the second diffuser stage to the first via a conduit 9. For the purpose of pH adjustment, sulfuric acid can be added to said recirculation conduit 9 via a separate conduit 9A.

The small amount of waste liquid which is drawn off from the bleaching plant is taken out from the first washing tower 7 double-diffuser via a conduit 8 from the first stage of the diffuser. If required, a separate conduit 8A can be taken from this waste conduit 8 to the washing press 2 for diluting the pulp after the washing press 2. This dilution liquid can also be obtained from the last washing tower 20 via conduit 21 and 2B. The filtrate from the washing tower 20 may be employed as washing liquid in the washing press 2 and in this case is conducted onwards via a separate conduit 2A. The filtrate from the washing press 2 is taken out via conduit 3 in order to be used in the oxygen-delignification stage.

An indication of how a supplementary bleaching stage can be added in the event that even greater brightness is required is given in FIG. 1 by the conduit shown as a broken line from X to Y. In the preferred embodiment shown in FIG. 1, the fourth stage comprises an additional P-stage, so that a QPZP bleaching sequence is obtained. Like the P-stage described previously, admixture of hydrogen peroxide (and optionally NaOH as well) occurs in a chute with attached MC pump via a conduit 22, after which the pulp is pumped to the bleaching tower 23, which is at the bottom of a reaction vessel and is fitted at the top with a washing diffuser. The wash water for the washing diffuser is appropriately, as in the above-described case, backwater at about 50° C., which is supplied via conduit 25. The filtrate from the wash is then led away via a heat exchanger, which is attached to the outlet conduit 24, and is led, at the appropriate temperature, into the washing tower 20, where it is used as washing liquid.

In a pulp line with a bleaching plant as described above, fully bleached pulp with a brightness of 85–90 ISO can be produced without using chlorine-containing chemicals. The volume of waste water from the bleaching plant can be kept at a very low level, 5 to 10 tons per ton of pulp and possibly as low as about 3 tons of waste water per ton of pulp. Apart from foreign substances, such as metal ions, released in the Q-stage, the waste water only contains organic substances, released in the peroxide and ozone stages, and spent bleaching chemicals supplied to the bleaching plant, i.e. mainly sodium ($Na^+$) and sulphate ions ($SO_4^-$).

The composition of the dry substance of the bleaching plant filtrate is to a large extent the same as that of spent digestion liquid (black liquor) from the digester. It can therefore either be added to the black liquor or in some other way introduced into the chemical recovery system of the factory. For optimal heat economy, the bleaching-plant filtrate should be wholly or partially concentrated, for example by evaporation of freeze-crystallization, before it is introduced into the recovery system. A part of the liquid can, if required, be employed, even without concentration, for dissolving the chemical smelt originating from the soda furnace. Heavy metals released in the bleaching stage are efficiently separated off by precipitation in the green liquor clarification or filtration. Any possible excess of sodium and/or sulphur is removed in a known manner, for example by bleeding off from the chemical cycle, or is employed as alkali (NaOH) in the bleaching plant after complete oxidation of the sodium sulphide ($Na_2S$), present in the white liquor, to sodium sulphate ($Na_2SO_4$).

In order to achieve the lowest possible consumption of chemicals and heat energy and the best possible quality of pulp in association with the lowest possible quantity of waste discharge from the bleaching plant, it is important that the bleaching plant system is configured in the correct manner with regard to water management and washing efficiency after the individual bleaching stages.

Laboratory experiments have shown that the washing efficiency after the Q-stage should be at least 85%, preferably 90–95%, (determined according to the equation $100(X-Y)/X$, where X is the quantity of undesirable substance before washing and Y is the quantity of the said substance remaining after washing, for a given amount of pulp) in order to be able to achieve high brightness and the best possible pulp viscosity in the subsequent peroxide stage(s). The reason for this is that even small quantities of metal ions in the peroxide stage cause decomposition of peroxide, which on the one hand increases consumption of peroxide and on the other lowers pulp viscosity.

Additional comments concerning a bleaching plant according to FIG. 1 are given below, as, in some measure, are directions regarding alternatives to the preferred embodiment shown in FIG. 1.

FIG. 1 shows a two-stage washing apparatus after the Q-stage, (e.g., A KAMYR, 2-stage double-diffuser). The washing efficiency with this apparatus is most preferred about 95%. In this double-diffuser, the filtrate from the subsequent peroxide bleaching stage is used as the washing liquid. The additional displacement is about 2 tons of liquid per ton of pulp. If the pulp concentration in the Q-stage is 10%, the amount of liquid employed is preferably 9 tons per ton of dry pulp. With the additional displacement, the total discharge from the Q-stage becomes about 11 tons of liquid per ton of dry pulp. This quantity of filtrate is the only filtrate leaving the beaching system. It contains released organic substances from the P- and Z-stages, including spent bleaching chemicals and heavy metals released in the Q-stage. The filtrate can be concentrated by evaporation, for example by mechanical vapor compression at reduced pressure. The filtrate can also be concentrated by freeze-crystallization, in which pure water crystals are formed and are separated off while released dry matter remains in the enriched filtrate, which can be conducted to the recovery system of the factory.

The recovery system can vary. For example, a portion of the filtrate can be used for dissolving the soda smelt from the recovery boiler. The remainder of the filtrate can be concentrated and mixed with the black liquor. If required, the whole of the filtrate can be subjected to a limited pre-evaporation or freeze-crystallization to a liquid quantity which is adapted to the maximum quantity which can be fed to the soda dissolvers.

Alternatively, the whole of the filtrate can be pre-evaporated to the lowest possible quantity of liquid, which is then mixed with the black liquor, which goes to the usual evaporation system of the factory.

In order to limit energy consumption in the pre-evaporation stages or in the freeze-crystallization system, the quantity of filtrate leaving the washing apparatus of the Q-stage can be decreased by reusing a portion of this filtrate as dilution liquid prior to the Q-stage. In this case, to achieve a balance in liquid management, the supply of fresh water to the washing apparatus of the peroxide stage must be decreased to a corresponding degree and replaced with recirculated filtrate from the ozone stage. The degree of closure (recirculation) which is possible will depend on how many metal ions are introduced in the Q-stage together with the oxygen-delignified pulp.

As a result of the closure, an enrichment of both metal ions and released organic substances occurs in the filtrate of the Q-stage. Owing to this, the washing losses are increased over to the peroxide stage, which, if excessive, can impair the bleaching result. For pulps which do not have too high a content of heavy metals, and at low kappa numbers, the discharge from the Q-stage can be decreased to about 3 tons per ton of pulp by recirculation. In this way, a substantial decrease is obtained in necessary energy consumption in the pre-evaporation or freeze-crystallization systems. The supply of fresh water to the washing apparatus of the peroxide stage must be decreased to a corresponding degree and replaced with re-circulated filtrate from the Z-stage.

The peroxide stage is carried out at high temperature preferably 70°–90° C. while the temperature in the subsequent ozone stage should be about 40°–50° C. and not exceed about 50° C., in order to avoid too great a decrease in the viscosity, and hence the strength, of the bleached pulp. To avoid transfer of hot liquid from the peroxide stage to the ozone stage, the thermal efficiency in the washing apparatus after the peroxide stage should be high, at least 85%, and preferably 90% or as high as 95%.

Additionally, it is important that the carryover to the ozone stage of dry material and residual chemicals released in the peroxide stage be as small as possible. Otherwise, ozone is consumed in the oxidation of material already released from the pulp instead of releasing further lignin from the pulp fiber. For this reason, too, the degree of washing after the peroxide stage should be as high as possible and at least 85% but preferably 90% and more preferred 95%.

A third basis for efficient washing after the peroxide stage is that unused peroxide, $H_2O_2$, is effectively recirculated to the beginning of the peroxide stage by using filtrate from the washing stage after the peroxide stage as washing liquid for the washing apparatus after the Q-stage.

Preferably a KAMYR a single or double-diffuser is used as the washing apparatus after the peroxide stage. Preferably, the washer apparatus provides a total washing efficiency of about 95% and thereby fulfills requirements for washing efficiency. Most preferably a double-diffuser is used. Besides efficient temperature regulation, decreased carryover of released dry material, and recirculation of residual chemicals, there is also achieved improved heat economy by enclosing the peroxide stage between two washing devices of high washing efficiency.

By raising the thermal efficiency from 85% to about 95%, the quantity of steam required for the heat exchange for filtrate from the washing apparatus after the peroxide stage, used for the washing apparatus after the Q-stage, can be decreased by more than 30%.

When using alkaline filtrate from the peroxide stage as washing liquid for the washing apparatus after the Q-stage, there is a risk of re-precipitation of metal ions which have been chelated with EDTA. To achieve the best result, the pH in the Q-stage should preferably be 5–6. The filtrate from the peroxide stage preferably has a pH of 10–11.

The risk of re-precipitation can be substantially decreased by carrying out the wash after the Q-stage in two steps and by limiting the quantity of alkaline liquid which is transferred to the first washing stage to the dilution factor, i.e. about 2 tons. In order completely to eliminate any possible effect of this relatively low input of alkali, the washing liquid from stage P recirculated to stage Q can be neutralized by the addition of sulfuric acid ($H_2SO_4$).

Preferably, pure water at a temperature of 40°–45° C. is used as the washing liquid for the washing apparatus of the peroxide stage. If the thermal efficiency of the wash is sufficiently high, 90–95%, the temperature of the ozone stage is preferably 45°–50° C. A higher temperature should be avoided in order to decrease the risk of impairing the quality of the pulp.

The pH of the pulp suspension in the ozone stage is preferably pH 2.0–3.0. This is achieved by adding sulfuric acid, $H_2SO_2$, to the pulp prior to the ozone stage. The filtrate which is drawn off from the wash after the ozone stage thus has a correspondingly low pH. This filtrate is suitable for adding to the last washing apparatus after the oxygen-delignification stage. This apparatus should preferably be a washing press or other apparatus which gives an outgoing pulp consistency in the region of 20–35%.

The filtrate of the ozone stage can be used partly as washing liquid for the washing press and partly for diluting the pulp consistency entering the Q-stage from 20–35% to about 10%.

That part of the filtrate of the ozone stage which is used as washing liquid is preferably neutralized to about pH 6 in order to avoid lignin re-precipitation in the washing system after the oxygen-delignification stage.

As has been pointed out previously, the pH in the Q-stage is preferably pH 5–6. If required, additional sulfuric acid is added to adjust the pH. If, on dilution with the pulp from the last washing stage after oxygen-delignification, the acid filtrate from the ozone stage causes a lower pH than about 5, it may become necessary to add alkali (NaOH) to adjust to a pH of 5–6.

If the bleaching is concluded after the ozone stage and is limited to the sequence QPZ, backwater from a drying machine or possibly fresh water at a temperature of 40°–60° C., preferably 45°–55° C., is supplied to the washing apparatus after the ozone stage. This apparatus can have a somewhat lower washing efficiency than the washers of the Q- and P-stages, steps 3 and 5, respectively. In FIG. 1, a one-stage diffuser has been included which gives a washing efficiency of 85–90%.

To stabilize the brightness of the pulp and destroy residual ozone after the ozone stage, sulphur dioxide can, if required, be supplied to the pulp suspension after the ozone-stage reactor but before the washing apparatus of this stage. If required, alkali (NaOH) is also added for neutralization to pH 5–6.

If the highest brightness, 88–90 ISO, is required, an additional peroxide stage can be introduced after the ozone stage. The bleaching sequence then becomes QPZP. The last peroxide stage preferably has a temperature of 50°–65° C. The charge of peroxide used is preferably low, 1–3 kg $H_2O_2$ per ton of pulp. The washing after the P-stage can be carried out, for example, by a one-stage diffuser. The filtrate from this washing apparatus is used as the washing liquid for the washing apparatus after the ozone stage. The washing liquid used can be backwater from the drying machine or pure washing water at a temperature of 45°–55° C.

The invention will be more completely understood by reference to the following examples.

EXAMPLE 1

A softwood sulphate pulp prepared in a pulp line using modified MCC digestion and subsequently oxygen-delignified to a kappa number of about 12 with a viscosity of 1020 $dm^3/kg$, was treated with EDTA at 70° C. for 60 minutes. The charge of EDTA was 2 kg per ton of dry pulp and the pH of the liquid was about 6. After the treatment, the mixture was diluted with pure water and the pulp was pressed to different dry matter contents so that washing efficiencies of 85%, 90% and 95% were obtained. Pulps containing 15%, 10% and 5% of filtrate from the original EDTA-stage were subsequently bleached under conditions which were otherwise identical with 35 kg $H_2O_2$ per ton of pulp at 90° C. for 270 minutes and at a pH of about 11.

TABLE 1

| Washing efficiency | $H_2O$ used $kg^2$ BDMT | Kappa number | Brightness % ISO | Viscosity $dm^3/kg$ |
|---|---|---|---|---|
| 85 | 34.5 | 5.1 | 74.7 | 847 |
| 90 | 34.3 | 5.0 | 75.0 | 828 |
| 95 | 31.0 | 4.6 | 77.7 | 869 |

As is evident from Table 1, the washing efficiency of 95% gives the best result for the process, with the lowest consumption of chemicals and the lowest kappa number, i.e. the most effective delignification and the greatest brightness together with the highest pulp viscosity, i.e. with the least effect on the cellulose.

The results indicate that the washing efficiency should be 90–95%. It should be pointed out, however, that pulps with lower initial content of heavy metals may give a good bleaching result even with lower washing efficiencies. Nevertheless, the washing efficiency should not fall below about 85%. In order to achieve this result, the washing equipment after the Q-stage should give at least this efficiency, though 90–95% efficiency is preferred.

Bleaching conditions such as chemical charge, reaction temperature, dwell time, etc., will vary depending on that bleachability of the oxygen-bleached pulp. Example 2, below, demonstrates the difference between two different pulps, a pulp produced from Scandinavian softwood and a hardwood pulp produced from eucalyptus wood.

EXAMPLE 2

Softwood and Eucalyptus wood were prepared in a pulp line using modified MCC digestion and subsequent oxygen-delignification according to the preferred embodiment of the present invention as noted above and in Table 2 below, where Table 2 reports viscosity, pH, temperatures, amounts of reagents, and brightness results.

TABLE 2

| | Softwood | Eucalyptus |
|---|---|---|
| kappa number after oxygen stage | 12 | 7.4 |
| Viscosity $dm^3/kg$ | 1020 | 998 |
| Q-stage | | |
| EDTA kg/ADMT | 2.0 | 2.0 |
| pH | 6 | 5.4 |
| P1-stage | | |
| $H_2O_2$ kg/ADMT | 35 | 20 |
| NaOH kg/ADMT | 25 | 18 |
| Temperature °C. | 90 | 80 |
| pH | 11.0 | 11.3 |
| Viscosity $dm^3/kg$ | 895 | 932 |
| Brightness, ISO | 78.1 | 81.8 |
| Z-stage | | |
| Ozone $O_3$ kg/ADMT | 4.7 | 3.9 |
| pH | 2.4 | 2.8 |
| Viscosity $dm^3/kg$ | 791 | 761 |
| Brightness, ISO | 86.5 | 89.4 |
| P2-stage | | |
| H2O2 kg/ADMT | 2 | — |
| NaOH kg/ADMT | 4 | 0 |
| Temperature °C. | 70 | — |
| pH | 10 | — |
| Viscosity $dm^3/kg$ | 755 | — |
| Brightness, ISO | 90.2 | — |

As is evident from Table 2, for softwood pulp four bleaching stages with the sequence QPZP are required in order to achieve a brightness of 90 ISO, while with eucalyptus wood virtually the same brightness is achieved with only three bleaching stages, QPZ. In addition the consumption of bleaching agents is lower for this latter pulp type. This is due partly to the lower initial kappa number, but also to the fact that this type of pulp is easier to bleach even when starting from the same kappa number.

For softwood, the amount of COD, $Na^+$ and dry matter (DM) in the combined filtrates from the different bleaching stages was Using the described method of water management, and depending on the degree of closure and the quantity of filtrate going to evaporation and hence to chemical recovery, the following concentrations are obtained in the filtrate for 5 tons of filtrate per ton of pulp and 10 tons of filtrate per ton of pulp, respectively

| Quantity of filtrate ton/ADMT | COD % | $Na^+$ % | DM % |
|---|---|---|---|
| 5.0 | 1.90 | 0.77 | 0.46 |

-continued

| Quantity of filtrate ton/ADMT | COD % | $Na^+$ % | DM % |
|---|---|---|---|
| 10.0 | 0.98 | 0.39 | 0.23 |

It is evident that the concentration of dry matter in the filtrate is quite low, about 1% in the case of 10 tons of filtrate per ton of pulp and about 2% if the quantity of filtrate is decreased to 5 tons/ton of pulp. If the quantity of filtrate is decreased by evaporation or freeze-crystallization to 0.5 tons per ton of pulp, the corresponding concentration then becomes about 16%, i.e. about the same concentration as in the black liquor which goes for evaporation. The increased load on the evaporation plant, which 0.5 tons of extra filtrate represents, should in most cases not cause any problems with capacity. The proposed system should thus provide favorable conditions for solving the problem of restricting the effluent systems of the pulp factories and thereby radically decreasing environmental pollution.

It will be evident to the person skilled in the art that practice of the invention is not limited to that which has been described above. Thus, it is, for example, possible for the dry matter in the drawn-off filtrate to be concentrated by other methods, e.g. by osmosis, etc. In other respects as well, it is evident that the person skilled in the art can employ various types of apparatus to achieve what is sought by the invention, for example other known washing devices can be used, such as a pressure diffuser, filter, etc., as alternatives to the washing press (before the Q-stage). In addition, washing presses can be used instead of diffusers at certain points, for example, after the Q-stage and/or the P-stage. Furthermore, it is possible to use something other than a P-stage as the fourth bleaching stage, for example a hydrogen sulphite-stage.

What is claimed is:

1. A process for bleaching pulp in a bleaching plant without using chlorine containing chemicals comprising:

(1) sending pulp, that has been subjected to continuous digestion and then oxygen-delignification and then washing in a washing apparatus, through a washing press;

(2) treating, with agitation, the delignified washed pulp with sulfuric acid and a chelating agent, and adjusting the pH of the delignified washed pulp to 5.0–6.0;

(3) second washing the treated pulp in a washing apparatus having at least 85% efficiency and adjusting the pH of the second washed pulp to 9.5–11.5;

(4) bleaching the second washed pulp with hydrogen peroxide at an elevated temperature of about 70°–90° C.;

(5) third washing the hydrogen peroxide bleached pulp in a washing apparatus;

(6) adding sulfuric acid and ozone to the third washed pulp with mixing and adjusting the pH of the third washed pulp to 2.0–3.0;

(7) reacting the pulp with ozone at a temperature of 40°–55° C.;

(8) fourth washing the ozone reacted pulp in a washing apparatus having at least 85% efficiency and adjusting the pH of the ozone reacted pulp to 5.0–6.0;

wherein the majority of liquid filtrate from the bleaching process that is waste not to be recycled is drawn off from the washing apparatus of step 3, and wherein filtrate from washing apparatus of step 8 is recirculated and used in the washing apparatus of step 1 for the washing of pulp after oxygen-delignification.

2. The process according to claim 1, further comprising adding at least one pH adjusting agent to the pulp as needed in order to maintain the pH of water used: in step 1 at 5.0–6.0; in step 4 at 9.5–11.5; in step 5 at 10.0–11.0; in step 7 at 2.0–3.0; and in step 8 at 5.0–6.0.

3. The process according to claim 1, wherein step 5 is carried out at 40°–45° C. , and step 8 is carried out at 40°–60° C.

4. The process according to claim 1, wherein sulphur dioxide is supplied to the pulp, and sodium hydroxide is supplied to the pulp as needed to achieve a pH of 5.0–6.0, both being supplied after reacting the pulp with ozone in step 7 but before the step 8 washing.

5. The process according to claim 1, further comprising drawing off the ozone in the reaction vessel of step 7 and sending it to an ozone destroyer vessel.

6. The process according to claim 1, further comprising step 9 of bleaching the pulp with hydrogen sulphite and then washing in a washing apparatus.

7. The process according to claim 1, wherein filtrate from any of the washing steps is concentrated and used as an additive to black liquor in a pulp plant and used to dissolve chemical smelt originating from soda furnaces.

8. A process for bleaching pulp in a bleaching plant without using chlorine containing chemicals comprising:

(1) sending pulp, that has been subjected to continuous digestion and then oxygen-delignification and then washing in a washing apparatus, through a washing press;

(2) treating, with agitation the delignified washed pulp with sulfuric acid and a chelating agent, and adjusting the pH of the delignified washed pulp to 5.0–6.0;

(3) second washing the treated pulp in a washing apparatus selected from the group consisting of a washing press, a single diffuser washer, and a double-diffuser washer having at least 85% efficiency and adjusting the pH of the second washed pulp to 9.5–11.5;

(4) bleaching the second washed pulp with hydrogen peroxide in a reaction vessel fitted with a washing apparatus selected from the group consisting of a washing press, a single-diffuser washer, and a double-diffuser washer at a temperature of about 70°–90°;

(5) third washing the hydrogen peroxide bleached pulp in a washing apparatus selected from the group consisting of a washing press, a single-diffuser washer, and a double-diffuser washer;

(6) adding sulfuric acid and ozone to the third washed pulp with mixing and adjusting the pH of the third washed pulp to 2.0–3.0;

(7) reacting the pulp with ozone at a temperature of 40°–55° C.;

(8) fourth washing the ozone reacted pulp in a washing apparatus selected from the group consisting of a washing press, a single-diffuser washer, and a double-diffuser washer having at least 85% efficiency and adjusting the pH of ozone reacted pulp to 5.0–6.0;

wherein the majority of liquid filtrate from the bleaching process that is waste not to be recycled is drawn off from the washing apparatus of step 3, and wherein filtrate from washing apparatus of step 8 is recirculated and used in the washing apparatus for the washing of pulp after oxygen-delignification.

9. The process according to claim 8, further comprising adding at least one pH adjusting agent to the pulp as needed in order to maintain the pH of water used: in step 1 at 5.0–6.0; in step 4 at 9.5–11.5; in step 5 at 10.0–11.0; in step 7 at 2.0–3.0; and in step 8 at 5.0–6.0.

10. The process according to claim 9, wherein the washing apparatus of steps 3, 4, 5, and 8 are double-diffuser washers and the filtrate from the second stage of the double-diffuser washer of step 5 is recirculated as washing liquid to the step 5 double-diffuser washer's first stage and wherein the filtrate from washing step 5 is sent to a heat exchanger fed with steam so that the filtrate is preheated before it is conveyed to the double-diffuser washer of step 3, and wherein recirculation also occurs from stage 1 to stage 2 of the double-diffuser washer of step 3.

11. The process according to claim 8, wherein step 5 is carried out at 40°–45° C., and step 8 is carried out at 40°–60° C.

12. The process according to claim 8, wherein part of the filtrate from step 3 is drawn off and delivered to the washing press of step 1, and the washing apparatus of step 8 is a double-diffuser washer and part of the filtrate from the double-diffuser washer of step 8 is drawn off and delivered to the washing press of step 1.

13. The process according to claim 8, wherein the washing apparatus of steps 5 and 8 are double-diffuser washers and the second stage of the double-diffuser washer of step 5 receives fresh water at about 45° C. and receives filtrate from the double-diffuser washer of step 8.

14. The process according to claim 8, wherein the washing apparatus of step 8 is a double-diffuser washer and the filtrate from the double-diffuser washer of step 8 is partly used to dilute pulp entering step 2 and the filtrate from the washing press of step 1 is used in oxygen-delignification.

15. The process according to claim 8, further comprising step 9 of bleaching the pulp with hydrogen sulphite and then washing in a washing apparatus selected from the group consisting of a washing press, a single-diffuser washer, and a double-diffuser washer.

16. The process according to claim 8, wherein filtrate from any of the washing steps is concentrated and used as an additive to black liquor in a pulp plant and used to dissolve chemical smelt originating from soda furnaces.

17. A process of bleaching pulp in a bleaching plant without using chlorine containing chemicals comprising:

(1) sending pulp, that has been subjected to continuous digestion and then oxygen-delignification and then washing in a washing apparatus, through a washing press;

(2) treating, with agitation the delignified washed pulp with sulfuric acid and a chelating agent, and adjusting the pH of the delignified washed pulp to 5.0–6.0;

(3) second washing the treated pulp in a washing apparatus selected from the group consisting of a washing press, a single-diffuser washer, and a double-diffuser washer having at least 85% efficiency and adjusting the pH of the second washed pulp to 9.5–11.5;

(4) bleaching the second washed pulp with hydrogen peroxide in a reaction vessel fitted with a washing apparatus selected from the group consisting of a washing press, a single-diffuser washer, and a double-diffuser washer at a temperature of about 70–90;

(5) third washing the hydrogen peroxide bleached pulp in a washing apparatus selected from the group consisting of a washing press, a single- diffuser washer, and a double-diffuser washer;

(6) adding sulfuric acid and ozone to the third washed pulp With mixing and adjusting the pH of the third washed pulp to 2.0–3.0;

(7) reacting the pulp with ozone at a temperature of 40°–55° C.;

(8) fourth washing the ozone reacted pulp in a washing apparatus selected from the group consisting of a washing press, a single-diffuser washer, and a double-diffuser washer having at least 85% efficiency and adjusting the pH of the ozone reacted pulp to 5.0–6.0;

(9) bleaching the ozone reacted pulp with hydrogen peroxide and then washing in an apparatus selected from the group consisting of a washing press, a single- diffuser washer, and a double-diffuser washer having at least 85% efficiency, wherein the majority of liquid filtrate from the bleaching process that is waste not to be recycled is drawn off from the washing apparatus of step 3, and wherein filtrate from the washing apparatus of step 8 is recirculated and used in the washing water apparatus for the washing of pulp after oxygen-delignification, and wherein the filtrate from the step 9 washing apparatus is recirculated and used as washing liquid in the ozone washing of step 8.

18. The process according to claim 17, further comprising adding at least one pH adjusting agent to the pulp as needed in order to maintain the pH of water used: in step 1 at 5.0–6.0; in step 4 at 9.5–11.5; in step 5 at 10.0–11.0; in step 7 at 2.0–3.0; and in step 8 at 5.0–6.0.

19. The process according to claim 17, wherein step 5 is carried out at 40°–45°, step 8 is carried out at 40°–60° C. and step 9 is carried out at 50°–65° C. and the washing of step 9 is carried out at 45°–55° C.; the charge of peroxide used 1–3 kg of hydrogen peroxide per ton of pulp.

20. The process according to claim 17, wherein sulphur dioxide is supplied to the pulp, and sodium hydroxide is supplied to the pulp as needed to achieve a pH of 5.0–6.0, both being supplied after reacting the pulp with ozone in step 7 but before the step 8 washing.

21. The process according to claim 17, further comprising drawing off the ozone ins said reaction vessel of step 7 and sending it to an ozone destroyer vessel.

22. The process according to claim 17, wherein the washing apparatus of step 3, 4, 5, and 8 are double-diffuser washers and the filtrate from the second stage of the double-diffuser washer of step 5 is recirculated as washing liquid to the step 5 double-diffuser washer's first stage and wherein the filtrate from washing step 5 is sent to a heat exchange fed with steam so that the filtrate is preheated before it is conveyed to the double-diffuser washer of step 3 and wherein recirculation also occurs from stage 1 to stage 2 of the double-diffuser washer of step 3.

23. The process according to claim 17, wherein part of the filtrate from step 3 is drawn off and delivered to the washing press of step 1, and the washing apparatus of step 8 is a double-diffuser washer and part of the filtrate from the double-diffuser washer of step 8 is drawn off and delivered to the washing press of step 1.

24. The process according to claim 17, wherein the washing apparatus of steps 5 and 8 are double-diffuser washers and the second stage of the double-diffuser washer of step 5 receives fresh water at about 45° C. and receives filtrate from the double-diffuser washer of step 8.

25. The process according to claim 17, wherein the washing apparatus of step 8 is a double-diffuser washer and the filtrate from the double-diffuser washer of step 8 is partly used to dilute pulp entering step 2 and the filtrate from the washing press of step 1 is used in oxygen-delignification.

26. The process according to claim 17, wherein filtrate from any of the steps is concentrated and used as an additive to black liquor used in a pulp plant and used to dissolve the chemical smelt originating from the soda furnaces.

* * * * *